US010383377B1

(12) United States Patent
Scott et al.

(10) Patent No.: US 10,383,377 B1
(45) Date of Patent: Aug. 20, 2019

(54) ARTICULATING LOAD DISTRIBUTION SYSTEM

(71) Applicant: U.S. Government as Represented by the Secretary of the Army, Natick, MA (US)

(72) Inventors: Trevor H. Scott, Boston, MA (US); John A. Kirejczyk, Marlborough, MA (US); William F. Carney, Fredericksburg, VA (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 881 days.

(21) Appl. No.: 14/520,625

(22) Filed: Oct. 22, 2014

Related U.S. Application Data

(60) Provisional application No. 61/894,059, filed on Oct. 22, 2013.

(51) Int. Cl.

| | |
|---|---|
| ***A41D 13/05*** | (2006.01) |
| ***A45F 3/08*** | (2006.01) |
| ***A45F 3/06*** | (2006.01) |
| ***A45F 3/04*** | (2006.01) |
| ***A45F 3/14*** | (2006.01) |

(52) U.S. Cl.
CPC ..... *A41D 13/0531* (2013.01); *A41D 13/0512* (2013.01); *A41D 13/0518* (2013.01); *A45F 3/06* (2013.01); *A45F 3/08* (2013.01); *A45F 3/14* (2013.01); *A41D 2400/48* (2013.01); *A45F 2003/045* (2013.01); *A45F 2003/146* (2013.01)

(58) Field of Classification Search
CPC ..... A41D 13/0531; A41D 13/0512; A41D 13/0518; A41D 2400/48; A45F 3/06; A45F 3/08; A45F 3/14; A45F 2003/045; A45F 2003/146
USPC ..... 2/467, 459, 461, 462, 463; 434/86; 224/263, 261, 262, 576
See application file for complete search history.

(56) References Cited

U.S. PATENT DOCUMENTS 816,240 A * 3/1906 Mehlig ..... F16D 3/2052 464/115
835,215 A * 11/1906 Coates ..... F16C 1/04 464/115

(Continued)

*Primary Examiner* — Alissa J Tompkins
*Assistant Examiner* — Cameron A Carter
(74) *Attorney, Agent, or Firm* — Roger C. Phillips

(57) ABSTRACT

Apparatuses and systems are provided. For example, in one embodiment of apparatus an upper back-plate includes shoulder supports and a connector. The apparatus also includes an articulating spine adapted to connect to the upper back-plate connector. The articulating spine includes a plurality of vertebra. Each vertebra a longitudinal bore. Some vertebra is adapted to mate with another vertebra Compressible discs are provided having a bore adapted to reside on each vertebra. A lower back-plate includes a receiving portion adapted to one end of the articulating spine. A chord interconnects each vertebra by insertion of the chord through the vertebrae bores, a bore in the upper back-plate, and a bore in a lower back-plate. The lower back-plate is adapted to connect to a hip mounted belt. Other embodiments are provided that include apparatuses and systems having features similar to the system described above.

12 Claims, 11 Drawing Sheets

(56) References Cited

U.S. PATENT DOCUMENTS 1,276,117 A * 8/1918 Riebe ..... F16C 1/26 138/120
1,316,915 A * 9/1919 Meyer ..... A61F 5/028 602/19
2,104,486 A 1/1938 Johansen
3,191,828 A 6/1965 Senne
3,355,075 A 11/1967 Dean
3,452,362 A 7/1969 Korolick et al.
3,493,153 A 2/1970 Spady, Jr. et al.
3,563,431 A 2/1971 Pletz
3,648,907 A 3/1972 Romney
3,733,017 A 5/1973 Pletz
3,860,157 A 1/1975 Richards et al.
4,015,759 A 4/1977 Dreissigacker et al.
4,144,881 A * 3/1979 Chappell ..... A61F 2/30 602/16
4,189,076 A 2/1980 Zufich
4,194,656 A 3/1980 Zufich
4,214,685 A 7/1980 Pletz
4,303,186 A 12/1981 Ollinger, IV
4,318,502 A 3/1982 Lowe et al.
4,479,595 A 10/1984 Opsal
4,504,002 A 3/1985 Hall
4,660,751 A 4/1987 von Dewitz
4,676,418 A 6/1987 Lowe
4,697,285 A * 10/1987 Sylvester ..... F41H 1/02 2/2.5
4,771,767 A 9/1988 Steffee
4,911,346 A 3/1990 Shallman
5,020,941 A 6/1991 Bulin et al.
5,123,408 A * 6/1992 Gaines ..... A42B 3/0473 2/425
5,140,995 A * 8/1992 Uhl ..... A41D 13/0531 128/846
5,184,763 A 2/1993 Blaisdell et al.
5,328,447 A * 7/1994 Kapounek ..... A41D 13/0531 128/846
5,346,419 A 9/1994 Kaiser
5,400,801 A * 3/1995 Archer, III ..... A41D 13/0153 128/846
5,451,121 A 9/1995 Seligman
5,562,513 A 10/1996 Kaiser
5,586,561 A * 12/1996 Archer, III ..... A41D 13/0153 128/846
5,644,792 A * 7/1997 Tishler ..... F41H 1/02 2/2.5
5,676,701 A * 10/1997 Yuan ..... A61F 2/4425 606/247
5,768,717 A * 6/1998 Le Sueur ..... A41D 13/015 2/455
5,996,118 A * 12/1999 Carlone ..... A41D 13/04 2/463
6,120,213 A 9/2000 Stinton
6,296,644 B1 * 10/2001 Saurat ..... A61B 17/7013 606/256
6,687,920 B2 * 2/2004 Berns ..... A41D 13/0531 2/467
7,299,507 B1 * 11/2007 Hermoso ..... A41D 13/018 2/467
7,329,230 B2 * 2/2008 Mazzarolo ..... A41D 13/0531 128/846
7,987,523 B2 * 8/2011 Cole ..... A45F 5/00 2/102
8,182,439 B2 5/2012 Glenn
8,533,872 B1 * 9/2013 Rodriguez ..... F41H 1/02 2/2.5
8,561,866 B2 10/2013 Gleason, Jr.
8,572,762 B2 11/2013 Herbener et al.
9,370,237 B2 6/2016 Hiemenz
2003/0050581 A1 * 3/2003 Berns ..... A41D 13/0531 602/3
2003/0167560 A1 * 9/2003 LaShoto ..... A41D 13/015 2/463
2005/0082330 A1 4/2005 Fehlberg et al.
2007/0090143 A1 * 4/2007 Clayton, III ..... A45F 3/10 224/637
2009/0209894 A1 * 8/2009 McAllister ..... A41D 13/0531 602/19
2010/0122404 A1 * 5/2010 Bowlus ..... A41D 13/0531 2/467
2010/0170029 A1 * 7/2010 Kordecki ..... A41D 13/0512 2/462
2010/0263111 A1 * 10/2010 Leatt ..... A41D 13/0512 2/467
2012/0024924 A1 * 2/2012 Hexels ..... A45F 3/08 224/576
2012/0131736 A1 * 5/2012 Reimer ..... A41D 13/0531 2/467
2012/0192335 A1 * 8/2012 Crye ..... A41D 13/0007 2/102
2014/0224849 A1 * 8/2014 Hiemenz ..... A45F 3/04 224/271
2014/0245529 A1 * 9/2014 Beckman ..... A41D 13/0531 2/468
2014/0305982 A1 * 10/2014 Pelland ..... A45F 3/06 224/576
2015/0342329 A1 * 12/2015 Formosa ..... A41F 9/002 224/666

* cited by examiner

ARTICULATING LOAD DISTRIBUTION SYSTEM

CROSS-REFERENCE TO RELATED APPLICATIONS

This application claims benefit under 35 U.S.C. § 119(e) of U.S. Provisional Patent Application No. 61/894,059, filed on Oct. 22, 2013, and is incorporated herein by reference in its entirety.

STATEMENT OF GOVERNMENT INTEREST

The invention described herein may be manufactured and used by or for the U.S. Government for governmental purposes without the payment of any royalties thereon or therefor.

BACKGROUND

Field of the Invention

Embodiments of the present invention generally relate to apparatuses and systems for load distribution and more specifically to apparatuses and systems that help redistribute loads on a user.

Description of the Related Art

There are instances when a user needs to carry a heavy load or needs to insure that the load that they are carrying does not cause unwanted fatigue. The user may be a warfighter, a first emergency responder, athlete, manual labor worker, a medical patient, a person with an injury, or someone looking to prevent injury.

While many vests are capable of carrying items that carry a portion of the load being supported by the user, they are typically securely attached to the user through belts, straps, and etc. The weight of the vest and equipment is, in general, predominantly borne by the user's shoulders and back, which is a factor that can lead to physical distress, may limit mobility, and/or can cause injuries.

There are load-bearing structure such as backpacks that do strap to the user's waist and shoulders. However, these devices inhibit movement and distribute the load to the user's shoulders and back.

Thus there is a need for a device/system that provides less restrictive user movement while distributing a load to more portions of a user's body.

SUMMARY

Embodiments of the present invention generally relate to apparatuses and systems for load distribution and more specifically to apparatuses and systems that help redistribute loads on a user.

For example, in one embodiment of apparatus an upper back-plate includes shoulder supports and a connector. The apparatus also includes an articulating spine adapted to connect to the upper back-plate connector. The articulating spine includes a plurality of vertebra. Each vertebra includes a proximal end, a distal end, and a longitudinal bore. The proximal end of each vertebra is adapted to mate with either a distal end of another vertebra or the upper back-plate connector. Compressible discs are provided having a bore adapted to reside between the proximal end and distal end of each vertebra. A lower back-plate includes a receiving portion adapted to receive one end of the articulating spine. A cord interconnects each vertebra in said plurality of vertebra by insertion of the cord through the vertebrae bores, a bore in the upper back-plate, and a bore in a lower back-plate. The lower back-plate is adapted to connect to a hip mounted belt.

Other embodiments are provided that include apparatuses and systems having features similar to the system described above.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

In the following description, numerous specific details are set forth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

In short, material taught herein incorporates a loadbearing frame architecture that helps support the weight of a user's equipment and allows the user to shift the weight bearing down on the user's shoulders and hips. In various embodiments, the concept has three major components (i.e., a back frame, an articulating loadbearing column, and a hip belt mounting plate) described in greater detail below.

This application incorporates by reference, for all purposes, all of the material contained within U.S. patent application Ser. No. 14/313,476 filed on Jun. 24, 2014 and entitled "CENTRAL OSTEOARTICULAR RELIEF AND PERFORMANCE STRUCTURED LOAD DISTRIBUTION SYSTEM ("CORPS-LDS") DEVIDE AND MODULAR SCALABLE VEST ("MSV") SYSTEM."

Figure 1A:
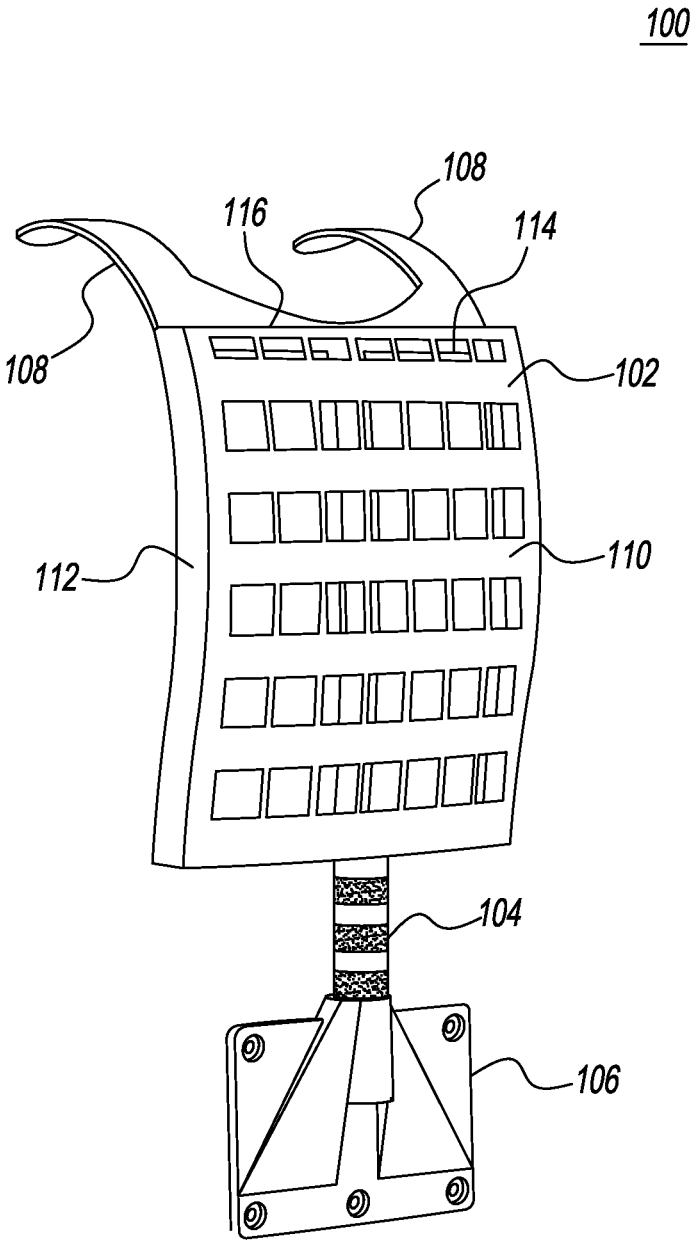
FIGS. 1A and 1B depict a perspective view of an embodiment in accordance with material taught herein.

FIGS. 1 and 1A depict perspective views of an embodiment of a loadbearing system 100 in accordance with material taught herein. Specifically, the loadbearing system 100 includes an upper back plate or a back frame 102 with an articulating column 104 at the base of the back frame 102 that connects to a lower back plate or a mounting plate 106 that is designed to attach to a hip belt (not shown).

The back frame 102 includes shoulder supports 108, a cage area 110, and a ball socket (not shown in FIGS. 1A and 1B) connected to the articulating column 104 (also referred to herein as "spine 104").

Figure 1B:
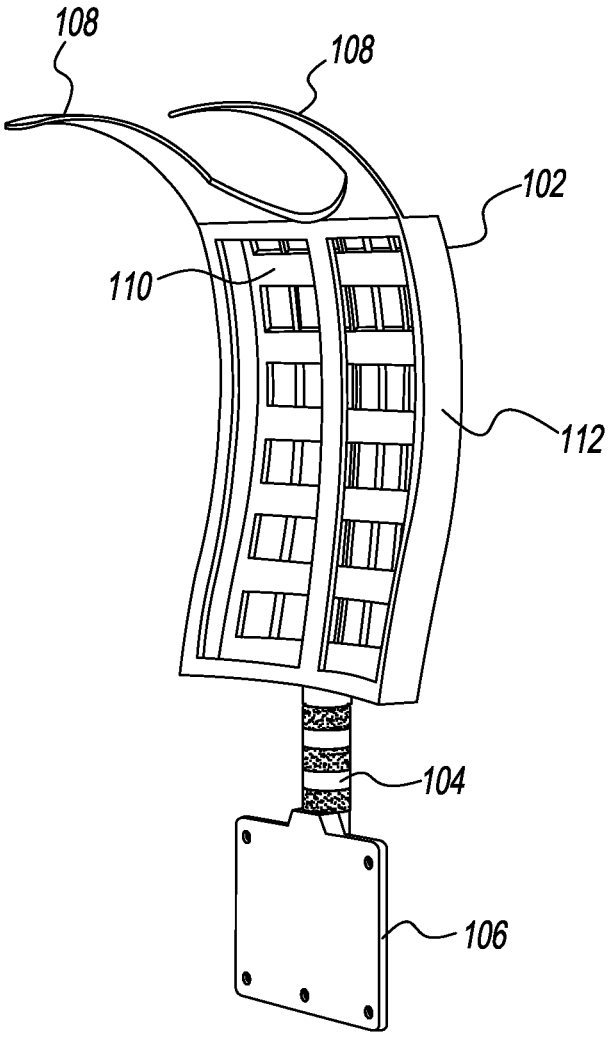

FIGS. 1A and 1B depict two shoulder supports 108 that generally extend from about the trapezium muscle to about the clavicle on both shoulders of a user. The shoulder supports 108 also extend from the cage area 110.

The cage area 110 is below the shoulder supports 108. In various embodiments, the cage area 110 is a frame in which various items can be inserted (e.g., a hard armor insert, equipment storage). Illustratively, the cage area 110 is a five-sided box with the top completely open to act as an insertion point 116 for the items. The cage portion 118 that touches the user's back has large openings 120 on either side of the user's spinal column to reduce weight.

In various embodiments, the side of the cage area 110 furthest away from the user's body has an access area(s). Illustratively, these access areas are described herein (and depicted in the figures) as being formed by slats 110. Illustratively, the slats 110 are a plurality of vertical and horizontal members that can be spaced at 1 inch intervals vertically and spaced at 1⅛ inch horizontally that allows for pouches and accessories to be attached directly to the back frame. However, this illustration is not intended in any way to limit the scope of the material taught herein. It is appreciated that in various embodiments, the side of the cage area 110 furthest away from a user can include more or less vertical members and further appreciated that the members (if included) can have other shapes/orientations with respect to cage area 110.

In various embodiments, the case area 110 has a curvature similar to the curvature of an Enhanced Small Arms Protective Insert.

A bottom section of the cage area 110 includes a portion adapted to receive the articulating column/spine 104.

In various embodiments, the bottom section (i.e., base) of the cage area 110 has a protrusion that includes a ball socket (not shown in FIGS. 1A and 1B) that extends substantially downward and is located substantially near the center of the bottom section. The protrusion (and ball socket) has a central bore through the longitudinal axis of the protrusion. The bore is adapted to receive an elastic cord/cable or other material (e.g., bungee cord) to run through the bottom portion and the articulating column/spine 104 to hold the articulating column/spine 104 inline. Inside the cage area 110 where the bore in the protrusion terminates, is a rectangular recess (not shown in FIGS. 1A and 1B) to hold a swage (not shown in FIGS. 1A and 1B) at the end of the elastic cord that runs through the spinal column portion.

The articulating column/spine 104 includes discs 214 and ball/sockets 206. The discs 214 and ball/sockets 206 are described in greater detail below.

The mounting plate 106 is secured (e.g., via rivets) to a hip belt (not shown) and is typically positioned on the hip belt so that it is located at the small of the back on the body of the user. Although not shown in the FIGS. 1A and 1B, a ball on the last ball/socket 206 in the articulated column/spine 104 nests in a recessed socket (not shown), that is adapted to receive the ball, on the mounting plate 106. The mounting plate 106 is explained in greater detail below.

The cord/cable that is through the entire length of the bore in the articulating column/spine 104 terminates on one end at the bottom of the cage area 110 (as indicated above). The other end of the cord/cable terminates in a portion of the mounting plate 106 in some manner that keeps tension on the ball/sockets 206 and discs 214. The cable/cord has enough elasticity to allow the user to bend and allow for the spinal column to disengage during motion and then reengage when the user stands upright.

As explained below, the support and load distribution can be tailored to the needs of the user. For example, in various embodiments taught herein, the cable/cord can be swapped with a cable/cord providing a tension level more suited to the needs of the user. In addition, the discs 214 can also be swapped for discs that provide a compression level more suited for the user. The user's needs can be, but is not limited to, related to a medical condition(s) or a specific activity (e.g., carrying construction loads, sports/recreational activity loads, emergency first responder loads, and/or a desired load capacity).

Figure 2:
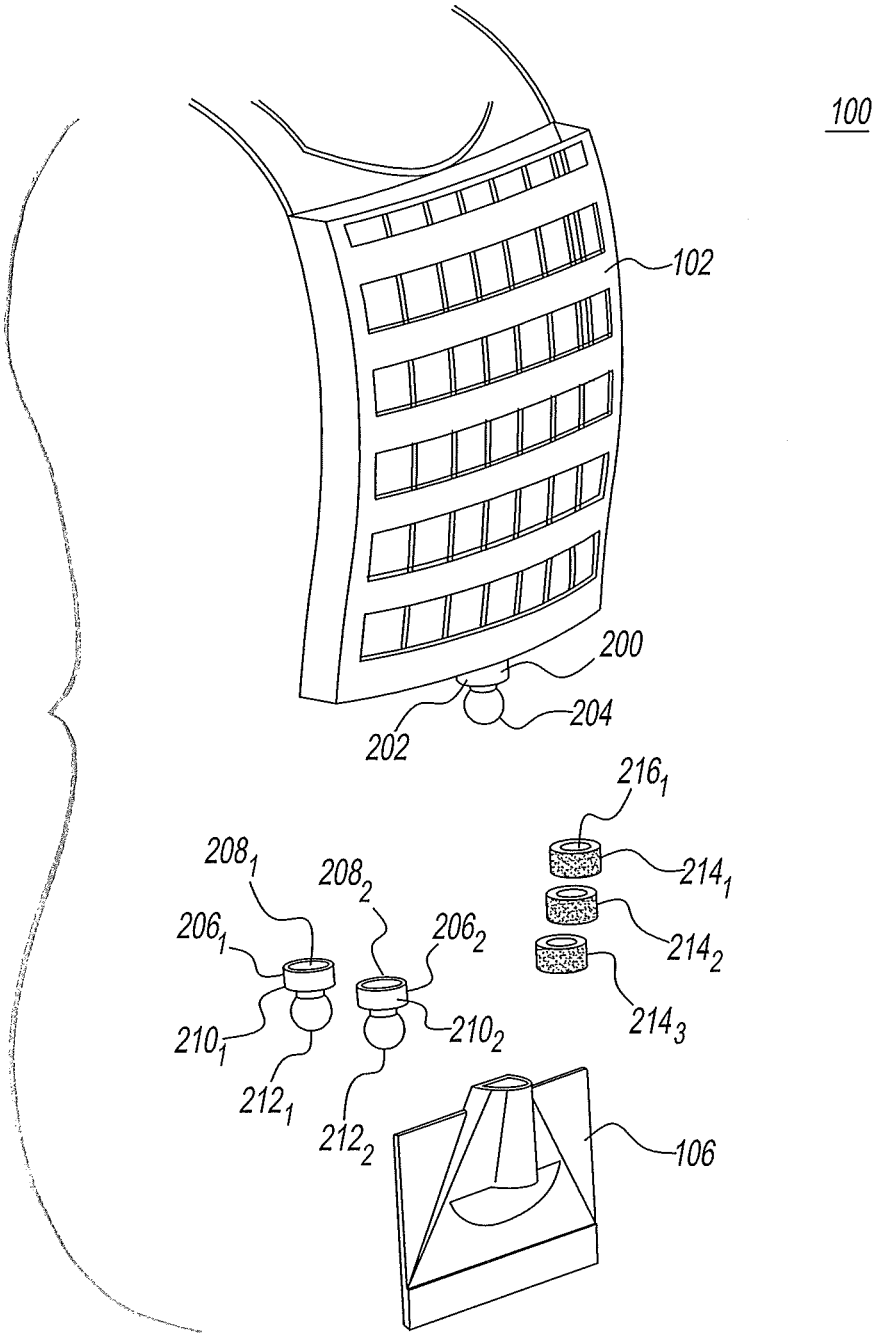
FIG. 2 depicts another perspective view of the embodiment depicted in FIGS. 1A and 1B.

In FIG. 2, an upper back plate connector or a protrusion 200 is depicted on a bottom portion of the cage area 102. The protrusion 200 includes a substantially circular vertebrae portion 202 and a ball joint 202. As indicated above, the protrusion 200 includes a bore through its longitudinal axis. The ball portion 202 is adapted to receive a disc 214.

In FIG. 2, a protrusion 200 is depicted on a bottom portion of the cage area 102. The protrusion 200 includes a substantially circular vertebrae portion 202 and a ball joint 204. As indicated above, the protrusion 200 includes a bore through its longitudinal axis. The ball portion 204 is adapted to receive a disc 214.

There is a plurality of discs 214 in the articulating spine 104. For illustrative purposes only, FIG. 2 depicts discs $\mathbf{214}_1$, $\mathbf{214}_2$, and $\mathbf{214}_3$ (collectively referred to herein as "discs 214"); and spine members $\mathbf{206}_1$, $\mathbf{206}_2$, and $\mathbf{206}_3$ (collectively referred to herein as "spine members 206"). Each of the spine members $\mathbf{206}_1$, $\mathbf{206}_2$, and $\mathbf{206}_3$ includes a vertebra portion $\mathbf{210}_1$, $\mathbf{210}_2$, and $\mathbf{210}_3$, (collectively referred to herein as "vertebrae 210"), respectively; and a ball joint $\mathbf{212}_1$, $\mathbf{212}_2$, and $\mathbf{212}_3$, (collectively referred to herein as "ball joints 212"), respectively. The depiction of three discs 214 and three spine members 206 is for illustrative purposes only and is not intended in any way to limit the scope of the material taught herein.

Further, the descriptions/depictions of the protrusion 200 as having a substantially circular vertebra 202 and vertebrae portions 210 as having a substantially circular shape is for illustratively purposes only and is not intended in any way to limit the scope of the material taught herein. It is appreciated that in various embodiments, the vertebrae 202, vertebrae portions 210, and discs 214 have shape that is other than substantially circular.

Figure 3:
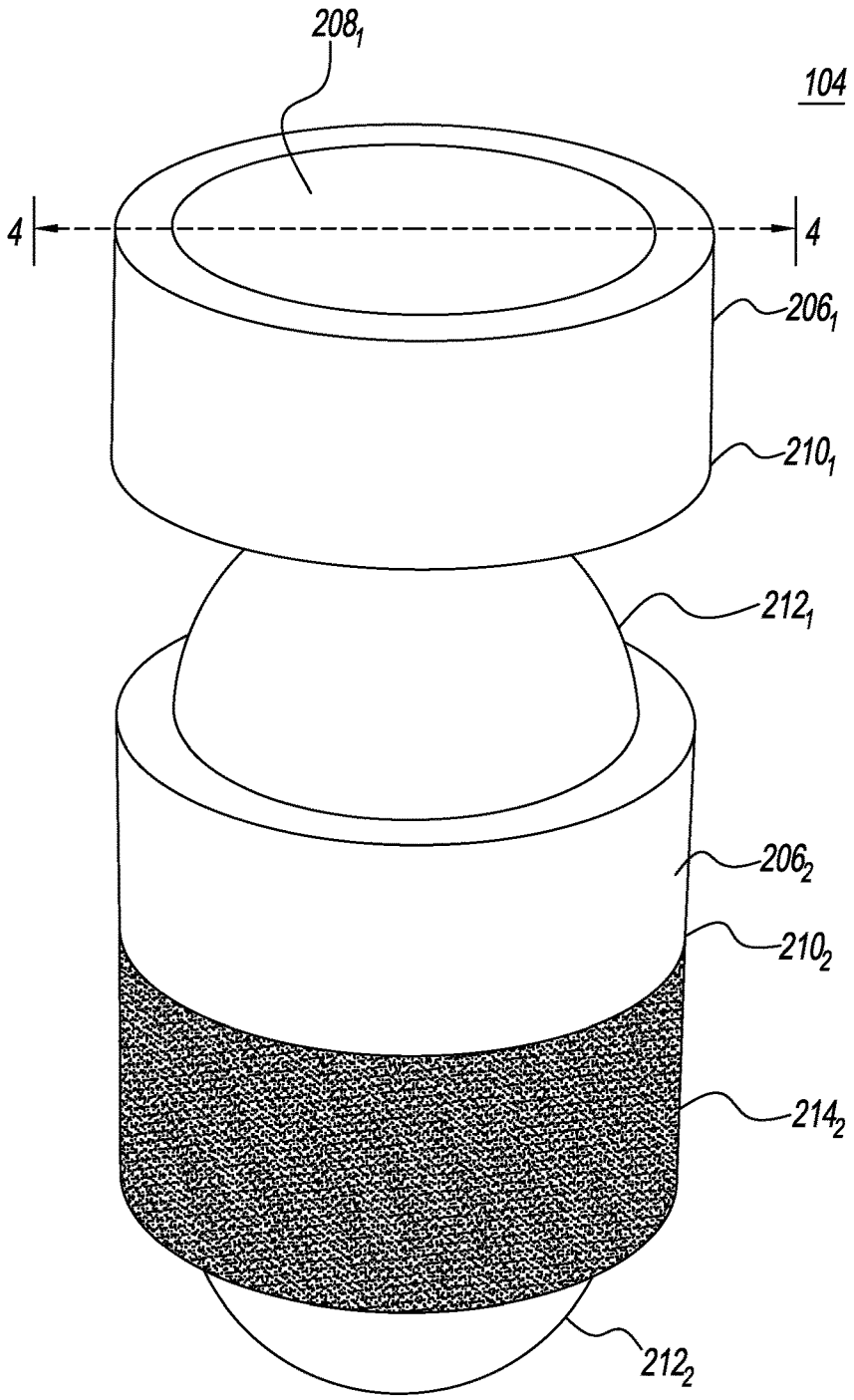
FIG. 3 depicts a close-up perspective view of a portion the embodiment depicted in FIGS. 1A and 1B.

FIG. 3 depicts a close-up perspective view of an embodiment of an articulating spine 104. Specifically, FIG. 3 depicts spine member $\mathbf{206}_1$ coupled to spine member $\mathbf{206}_2$. Each spine member 206 includes a concave surface 208 on one end, a vertebra 210, and a ball joint 212 on the other end. A concave surface 208 on one vertebra 210 of a spine member 206 is adapted to receive a ball joint 212 from another spine member 206. For illustrative purposes, FIG. 3 depicts the ball joint $\mathbf{212}_1$ of spine member $\mathbf{206}_1$ residing in the concave surface of spine member 206$_2$. FIG. 3 also depicts proper placement of a disc 214$_2$ onto a spine member 206 (e.g., spine member 206$_2$).

Figure 4:
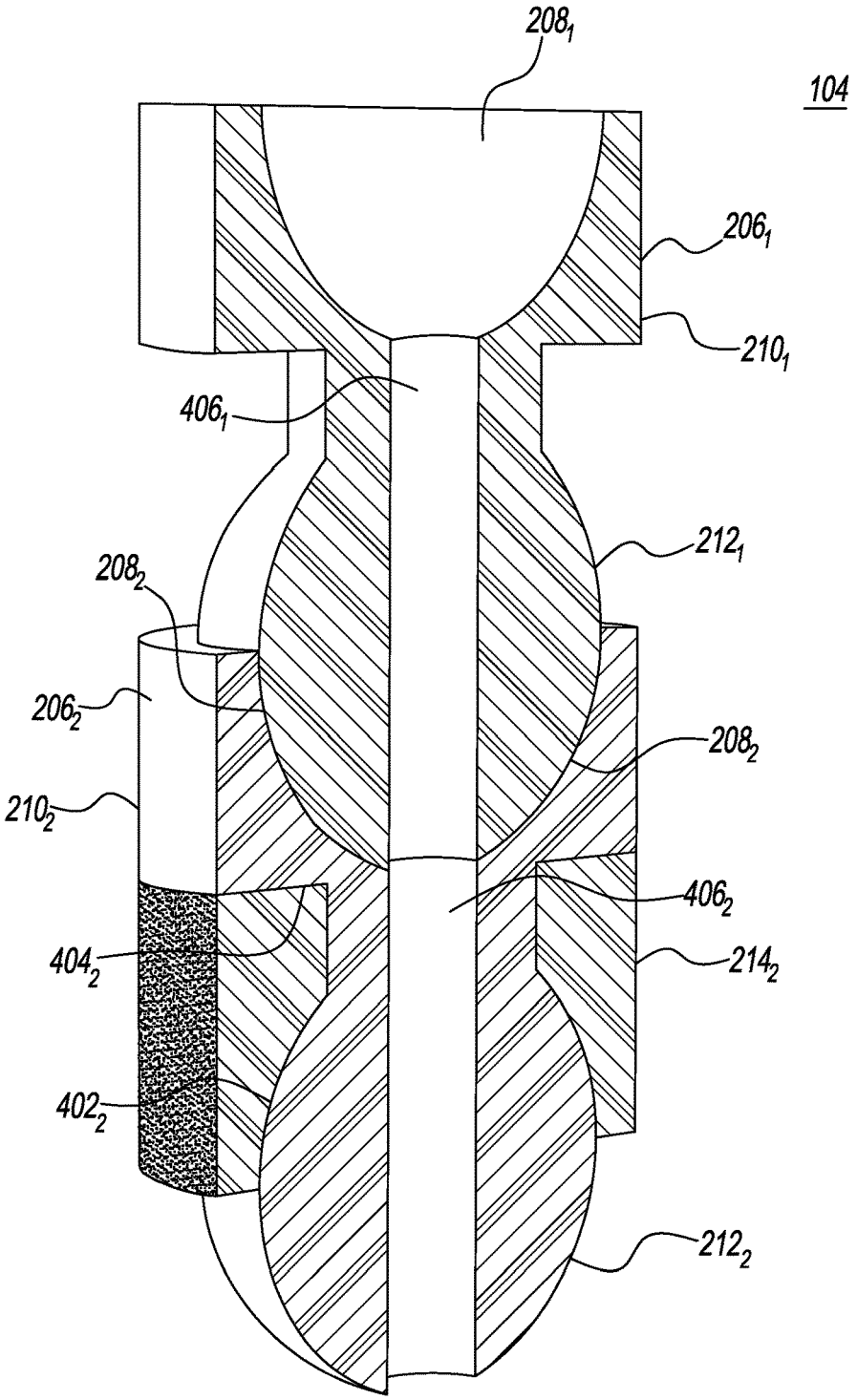
FIG. 4 depicts another perspective view of FIG. 3.

FIG. 4 depicts another perspective view along the 4-4 line in FIG. 3. Specifically, FIG. 4 depicts a close-up perspective view of a cross-section of spine members 206 and discs 214. Each disc 214 includes a bore sufficient in size for the disc 214 to pass over the ball joint 212. One side of the disc 214 includes a substantially flush portion 404 adapted to receive a stem 400 (on the spine member 206) and abut against the vertebrae portion 210. The other side of the disc 214 includes a concave portion 402 to abut against the ball joint 212 of the spine member 206.

The stem 400 is located between the ball joint 212 and the vertebrae portion 210. Each spine member 206 includes a stem 400 (i.e., 400$_1$, 400$_2$, . . . , etc. and are collectively referred to herein as "stems 400").

Each disc 214 includes a concave portion 402 (i.e., 402$_1$, 402$_2$, . . . , etc. and are collectively referred to herein as "concave portions 402") and a substantially flush portion 404 (i.e., 404$_1$, 404$_2$, . . . , etc. and are collectively referred to herein as "substantially flush portions 404").

As indicated above, a bore 406 runs through the longitudinal axis of spine members 206. When the spine members 206 are aligned and interconnected with the discs 214 a cord/cable (not shown) is strung through the aligned bores 406. The discs 214 slide over the ball joint 212 and stay securely in place. The discs 214 allow the user to bend at the hips, side-to-side, and front to back. When the user bends, the disc 214 will compress and the nested ball and sockets will slide and pivot allowing the user to move. When the user is standing or moving upright, a portion of the load from the cage area 102 will transfer down through the articulated spine 104 and to the mounting plate 106.

Figure 5A:
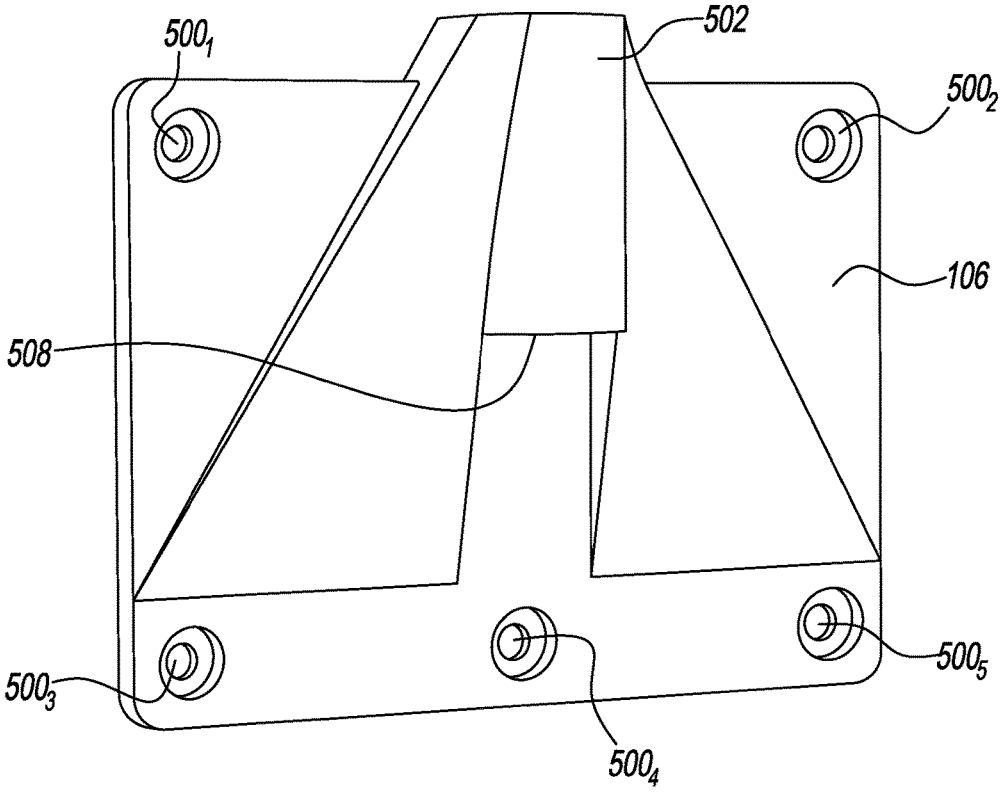
FIGS. 5A and 5B depict a perspective view of another portion of the embodiment depicted in FIGS. 1A and 1B.
Figure 5B:
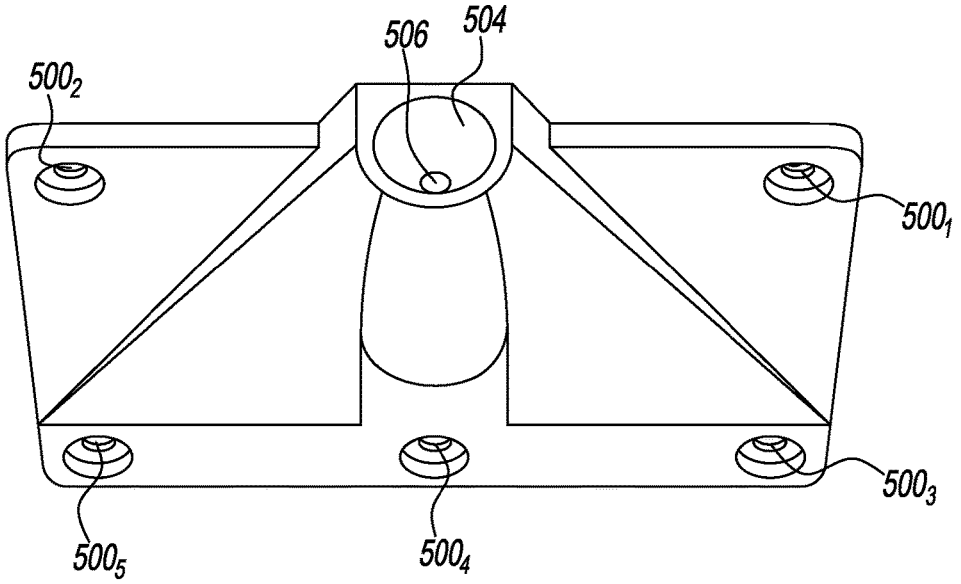

FIGS. 5A and 5B depict a perspective view of another portion of the embodiment depicted in FIG. 1. Specifically, FIGS. 5A and 5B depict the front and back, respectively, of an embodiment of a mounting plate 106. Illustratively, the mounting plate 106 includes holes 500$_1$, 500$_2$, 500$_3$, 500$_4$, and 500$_4$ for securing the mounting plate 106 to a belt (not shown). However, it is appreciated that the mounting plate 106 can include more or less holes for securing the mounting plate 106 to the belt.

The mounting plate 106 to the belt includes a tube 502 having two ends. One end of the tube 502 includes a ball socket 504 that is adapted to receive a ball joint 212. The tube 502 also includes a bore 506 that runs through the entire tube 502 and aligns with the bores on the vertebrae 206. The other end 508 of the tube 502 includes a mechanism (not shown) for locking an end of the cord that has passed through the tube 502. For example, in various embodiments, the locking mechanism is a swage on the end of the cord that fits within a cutout portion on end 508 that is adapted to receive and secure the end of the cord.

Figure 6B:
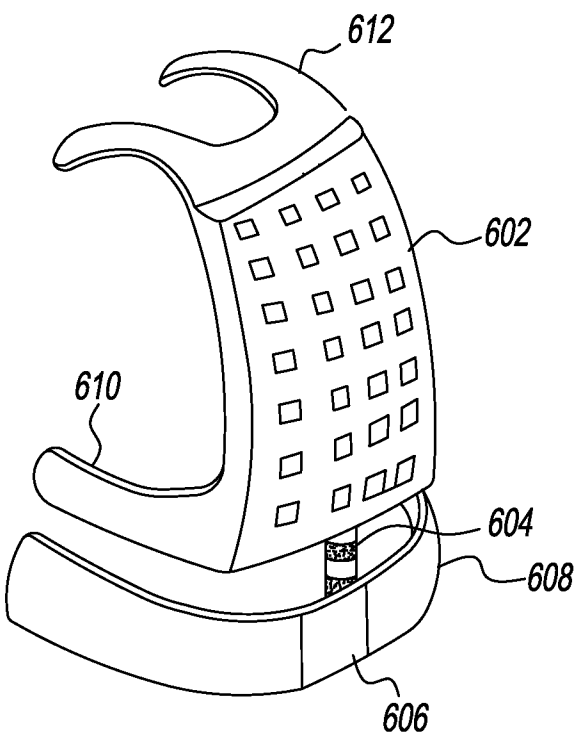
FIGS. 6A and 6B depict perspective views of another embodiment in accordance with material taught herein.
Figure 6A:
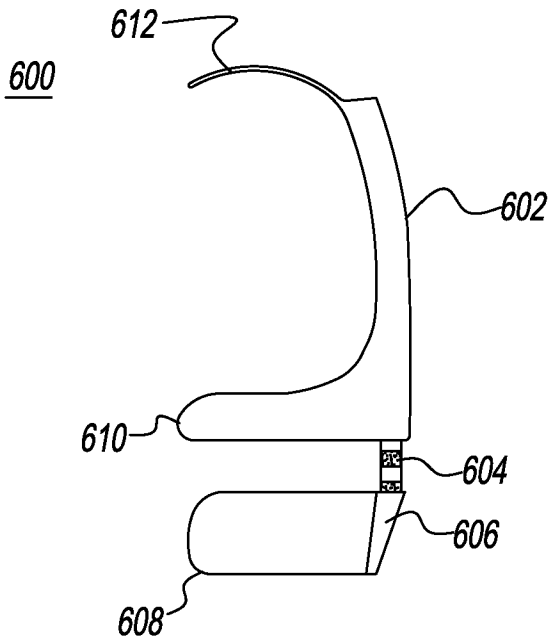

FIGS. 6A and 6B depict perspective views of another embodiment in accordance with material taught herein. Specifically, FIGS. 6A and 6B depict a side view and a perspective view of an embodiment of a load distribution system 600, respectively. The system 600 includes a cage area 602, a spine 604, a mounting plate 606, a hip support belt 608, a rib support strap 610, and a shoulder support 612.

The cage area 602, spine 604, hip support belt 608, and shoulder support 612 operate substantially similar to the description of FIG. 1. For brevity, that description is not repeated. However, system 600 includes a rib support 610 to provide an even greater level of user support while not significantly restricting the user's movements. Although not shown in FIG. 6, ends of the rib support 610 can be secured together via a locking mechanism on the ends of the rib support 610 (e.g., snaps or hook/loop fasteners).

Figure 6C:
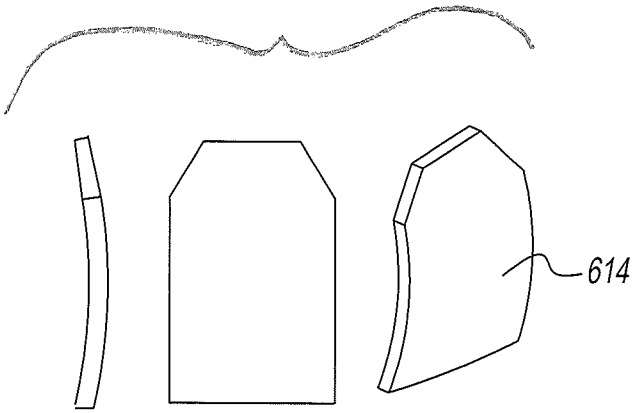
FIG. 6C depicts a perspective view of an embodiment in accordance with material taught herein.

FIG. 6C depicts a perspective view of an embodiment in accordance with material taught herein. Specifically, FIG. 6C depicts an exemplary protective plate 614 that can be inserted in the cage area 102 as explained above.

Figure 7B:
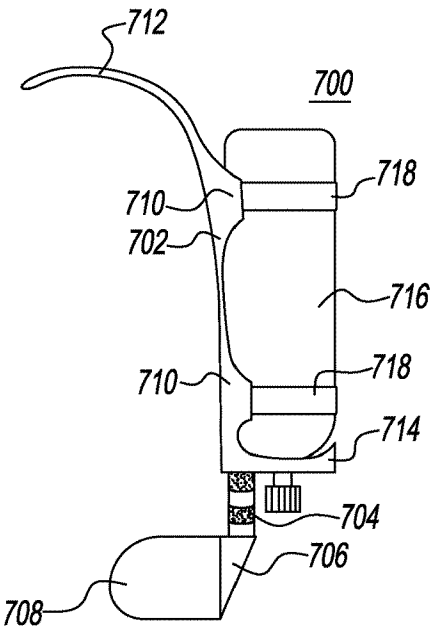
FIGS. 7A and 7B depict perspective views of another embodiment in accordance with material taught herein.
Figure 7A:
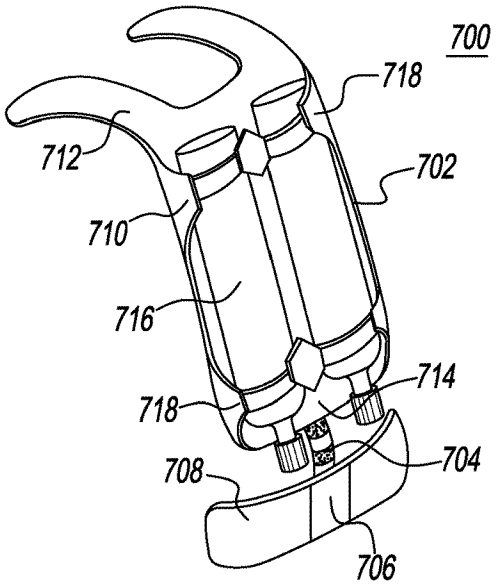

FIGS. 7A and 7B depict perspective views of another embodiment of a system 700 in accordance with material taught herein. FIGS. 7A and 7B depict a side and a perspective view, respectively of the system 700. Specifically, the system 700 includes a load that is multiple air cylinders 716. The system 700 includes a cage area 702, a spine 704, a mounting plate 706, a hip support 708, side flanges 710, and shoulder straps 712. The spine 704, mounting plate 706, hip support belt 708, and shoulder support 712 operate substantially similar to the description of FIG. 1. For brevity, that description is not repeated.

System 700 includes side flanges 710, bottom flanges 714, and straps 718 to secure the air cylinders 716 to the cage area 702. Note that the cage area 702 is contoured to accommodate the intended load (i.e., the air cylinders 716).

Figure 8:
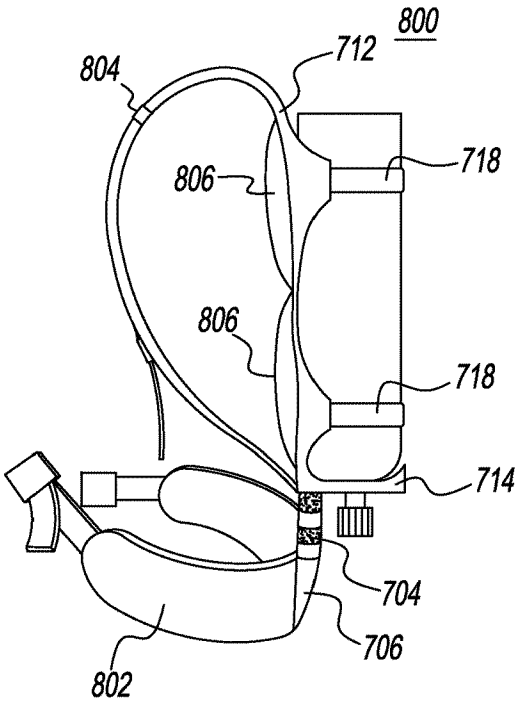
FIG. 8 depicts a perspective view of an embodiment in accordance with material taught herein.

FIG. 8 depicts a perspective view of an embodiment of a system 800 in accordance with material taught herein. The system 800 includes those elements already described with respect to FIGS. 7A and 7B with the addition of a padded hip belt 802, a padded shoulder strap 804, and back padding 806. The padded hip belt 802, padded shoulder strap 804, and back padding 806 help decrease user fatigue or discomfort where the padding contacts the user's body.

Figure 9:
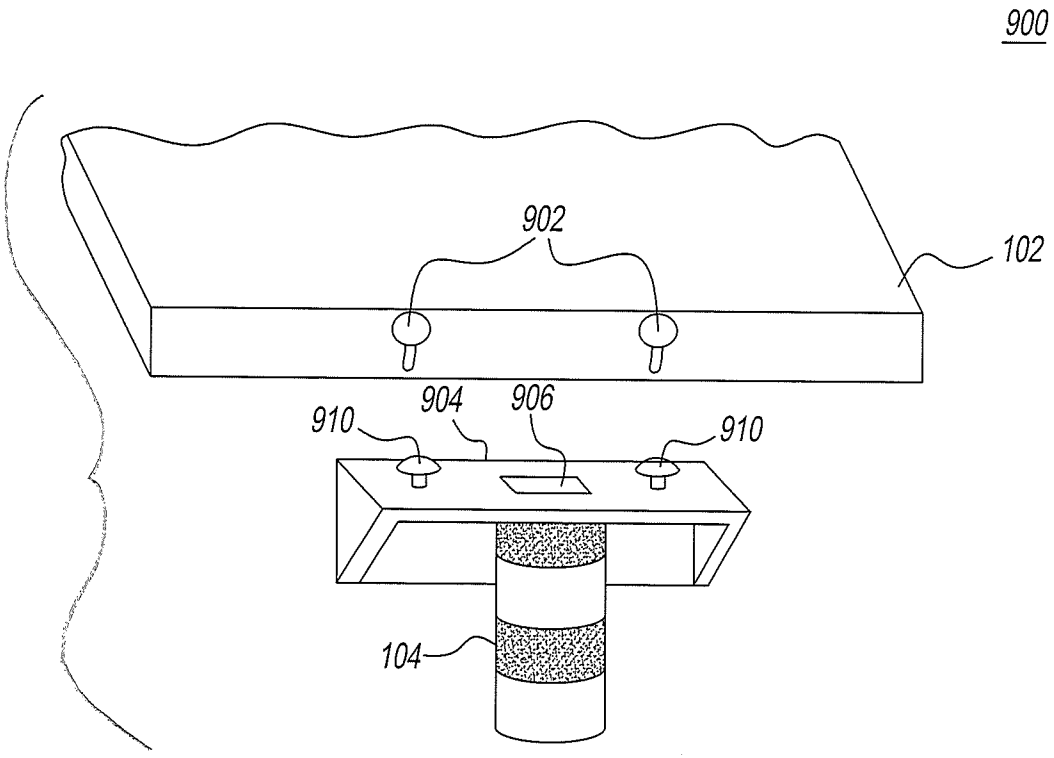
FIG. 9 depicts a perspective view of an embodiment in accordance with material taught herein.

FIG. 9 depicts a perspective view of an embodiment of a system 900 in accordance with material taught herein. Specifically, the system 900 depicts an alternative way of attaching/detaching the spine 104 from a load distribution system. In various embodiments, the system 900 is incorporated into the other devices/systems taught herein.

A bottom portion of the cage area 102 is depicted in FIG. 9. The bottom portion has two slotted screw holes 902 adapted to receive screws 910 located on a mounting bracket 904. Once screws 910 are inserted into the hole portions of 902 the mounting bracket 904 is adjusted so that the screws 910 are on the slotted portion of 902 thus locking the mounting bracket against the cage area 102. Removal of the mounting bracket 904 is accomplished by sliding the mounting bracket 904 towards the slotted screw holds 902 and separating the mounting bracket 904 from the cage area 102.

The mounting bracket 904 also includes a "T-bar" mount 906 for insertion of the cord/cable into the mounting bracket 904. This allows a user multiple ways in which to make adjustments to a load system (e.g., to change cord/cable to one having different tension characteristics or change the entire spine 104).

As used herein, the terms "having," "containing," "including," "comprising" and the like are open ended terms that indicate the presence of stated elements or features, but do not preclude additional elements or features. The articles "a," "an," and "the" are intended to include the plural as well as the singular, unless the context clearly indicates otherwise.

While the foregoing is directed to embodiments of the present invention, other and further embodiments of the invention may be devised without departing from the basic scope thereof, and the scope thereof is determined by the claims that follow.

We claim:

1. A system comprising:

an upper back-plate, wherein said upper back-plate includes shoulder supports and a connector;

an articulating spine adapted to connect to said upper back-plate connector, wherein said articulating spine includes a plurality of vertebra, each vertebra in said plurality includes a proximal end, a distal end, and a longitudinal bore, wherein each said proximal end in said plurality of vertebra is adapted to mate with one of a distal end in said plurality of vertebra and said upper back-plate connector and wherein each said proximal end and said distal end in said plurality of vertebra are configured as a ball joint providing for three-dimensional movement between each of said plurality of vertebra;

at least one compressible disc, wherein each said at least one compressible disc includes a proximal end, a distal end, and a bore, each said at least one compressible disc bore is adapted to pass over said distal end of a vertebra in said plurality of vertebra so that a compressible disc in said at least one compressible disc resides between each said proximal end of said vertebra in said plurality of vertebra and each said distal end of said vertebra in said plurality of vertebra;

a lower back-plate, wherein said lower back-plate includes a receiving portion adapted to receive one distal end of said vertebra in said plurality of vertebra, a substantially vertical bore through said receiving portion.

2. The system of claim 1 further comprising a belt adapted to receive said lower back-plate.

3. The system of claim 1 wherein a cord interconnects each said vertebra in said plurality of vertebra by insertion of said cord into each said bore in said plurality of vertebra.

4. The system of claim 3 wherein said cord is elastic.

5. The system of claim 3, wherein said upper back-plate connector is a protrusion having a ball joint adapted to mate with one proximal end of a first vertebra in said plurality of vertebra, said protrusion having a bore that is adapted to receive said cord, said upper back-plate is adapted to receive one end of said cord through said protrusion and secure said one end of said cord to said upper back-plate.

6. The system of claim 3 wherein said upper back-plate connector has a plurality of screw holes having a slotted portion.

7. The system of claim 6 further comprising:

a mounting bracket coupled by said cord to a first vertebra in said plurality of vertebra, said mounting bracket having a portion adapted to receive and secure one end of said cord to said mounting bracket; and a plurality of mounting screws positioned on said mounting bracket, wherein said plurality of mounting screws mate with said screw holes in said back-plate connector.

8. The system of claim 1 wherein said upper back-plate further includes a rib support.

9. The system of claim 1 wherein said upper back-plate comprises a cage area, said cage area includes a top that is open.

10. The system of claim 1 further comprising:

padded shoulder straps connected to said shoulder supports;

a padded hip belt adapted to mate with said lower back-plate; and back padding coupled to said upper back-plate.

11. The system of claim 1 further comprising:

a plurality of side flanges connected to sides of said upper back-plate;

bottom flanges connected to a bottom portion of said upper back-plate, wherein said bottom flanges and said plurality of side flanges are adapted to define an area for a load; and straps connected to said plurality of side flanges, wherein said straps are adapted to secure said load to said area.

12. The system of claim 11 wherein said load comprises a plurality of air cylinders.

* * * * *